US007478606B2

(12) United States Patent
Park et al.

(10) Patent No.: US 7,478,606 B2
(45) Date of Patent: Jan. 20, 2009

(54) SEWING MACHINE

(75) Inventors: Ham-Kyu Park, Busan-si (KR); Il-Gyu Park, Busan-si (KR)

(73) Assignee: Inbro Co., Ltd. (KR)

( * ) Notice: Subject to any disclaimer, the term of this patent is extended or adjusted under 35 U.S.C. 154(b) by 12 days.

(21) Appl. No.: 11/570,824

(22) PCT Filed: Jun. 16, 2005

(86) PCT No.: PCT/KR2005/001851

§ 371 (c)(1),
(2), (4) Date: Dec. 18, 2006

(87) PCT Pub. No.: WO2005/124004

PCT Pub. Date: Dec. 29, 2005

(65) Prior Publication Data

US 2007/0215026 A1 Sep. 20, 2007

(30) Foreign Application Priority Data

Jun. 18, 2004 (KR) ..... 10-2004-0045676

(51) Int. Cl.
*D05B 55/00* (2006.01)
*D05B 87/00* (2006.01)
*D05B 69/00* (2006.01)

(52) U.S. Cl. ..... 112/221; 112/225

(58) Field of Classification Search ..... 112/220, 112/284, 237, 221, 89, 163, 225, 259
See application file for complete search history.

(56) References Cited

U.S. PATENT DOCUMENTS 4,343,251 A 8/1982 Goldbeck et al.
4,359,954 A * 11/1982 Dreier ..... 112/221
4,546,712 A * 10/1985 Willenbacher ..... 112/89
4,580,515 A * 4/1986 Shinoda ..... 112/163
5,086,719 A * 2/1992 Ogawa ..... 112/225
5,143,003 A 9/1992 Dedmon
5,515,798 A 5/1996 Cahuzac
5,590,614 A * 1/1997 Murata et al. ..... 112/237
7,337,734 B2 * 3/2008 Park et al. ..... 112/225

FOREIGN PATENT DOCUMENTS

JP 5190648 8/1976
KR 1020020031695 5/2002
KR 1020020068028 8/2002

OTHER PUBLICATIONS

International Search Report; PCT/KR2005/001851; Date: Aug. 30, 2005.
PCT Written Opinion of the International Searching Authority; PCT/KR2005/001851; Date: Aug. 30, 2005.

* cited by examiner

*Primary Examiner*—Ismael Izaguirre
(74) *Attorney, Agent, or Firm*—Cantor Colburn LLP

(57) ABSTRACT

The present invention relates to a sewing machine comprising a needle bar mounted with a needle reciprocating within a predetermined sewing work section, and a needle bar driver to drive the needle bar to reciprocate, the sewing machine further comprising a lifting unit to lift up and down the needle bar to make the needle get out of the sewing work section and reach a predetermined auxiliary work position; and a lifting driver driving the lifting unit to be lifted up and down. Thus, the present invention provides a sewing machine capable of decreasing work inconvenience and enhancing work efficiency.

3 Claims, 6 Drawing Sheets

SEWING MACHINE

FIELD OF THE INVENTION

The present invention relates to a sewing machine, and more particularly, to a sewing machine, in which a needle gets out of a sewing work section and is lifted up to a predetermined auxiliary work position.

BACKGROUND ART

An automatic embroidering machine is a kind of a sewing machine, which uses various colored threads and automatically embroiders a predetermined pattern, a trademark, or the like on clothes, a label of shoes, etc. according to a preset program.

As an example of the sewing machine, a single needle automatic embroidering machine having a single needle worktable has been disclosed in Korean Patent First Publication No. 2002-68028.

In the conventional automatic embroidering machine, when a thread is changed, one selected among a plurality of upper threads is supplied from a thread supplying unit to a needle via a guide tube assembly by compressed air, and then put through the needle by a threader placed within a sewing work section of the needle, i.e., adjacent to between a top dead point and a bottom dead point of the needle.

However, in such conventional sewing machine, the threader puts the thread through an eye of the needle in a place adjacent to the sewing work section of the needle. Therefore, in the case that a hat or the like is sewn, a workspace between the brim of the hat and the threader is insufficient, so that the hat and the threader interfere with each other. Thus, it is inconvenient to perform the sewing work, thereby decreasing work efficiency. Further, when the needle or the like is changed, it is inconvenient to change the needle or the like due to the insufficient workspace.

DISCLOSURE OF INVENTION

Accordingly, it is an aspect of the present invention to provide a sewing machine capable of decreasing work inconvenience and enhancing work efficiency.

The foregoing and other aspects of the present invention are achieved by providing a sewing machine comprising a needle bar mounted with a needle reciprocating within a predetermined sewing work section, and a needle bar driver to drive the needle bar to reciprocate, the sewing machine further comprising a lifting unit to lift up and down the needle bar to make the needle get out of the sewing work section and reach a predetermined auxiliary work position; and a lifting driver driving the lifting unit to be lifted up and down.

According to an aspect of the present invention, the sewing machine further comprises an elastic unit elastically connecting the lifting unit with the needle bar, and urging the needle bar to be lifted up by predetermined elasticity when the lifting unit is lifted up.

According to an aspect of the present invention, the sewing machine further comprises a stopper provided in the needle bar and limiting movement of the lifting unit to place the needle within the sewing work section when the lifting unit is lifted down.

According to an aspect of the present invention, the lifting driver comprises a hydraulic cylinder comprising a cylinder rod to reciprocate; and a link connecting the cylinder rod and the lifting unit, and transferring the reciprocation of the cylinder rod to the lifting unit.

According to an aspect of the present invention, the lifting unit comprises a projection protruded from an outer circumference of the needle bar; and a lifting rod lifted up and down being in contact with and apart from the projection.

MODES FOR CARRYING OUT THE INVENTION

Figure 1:
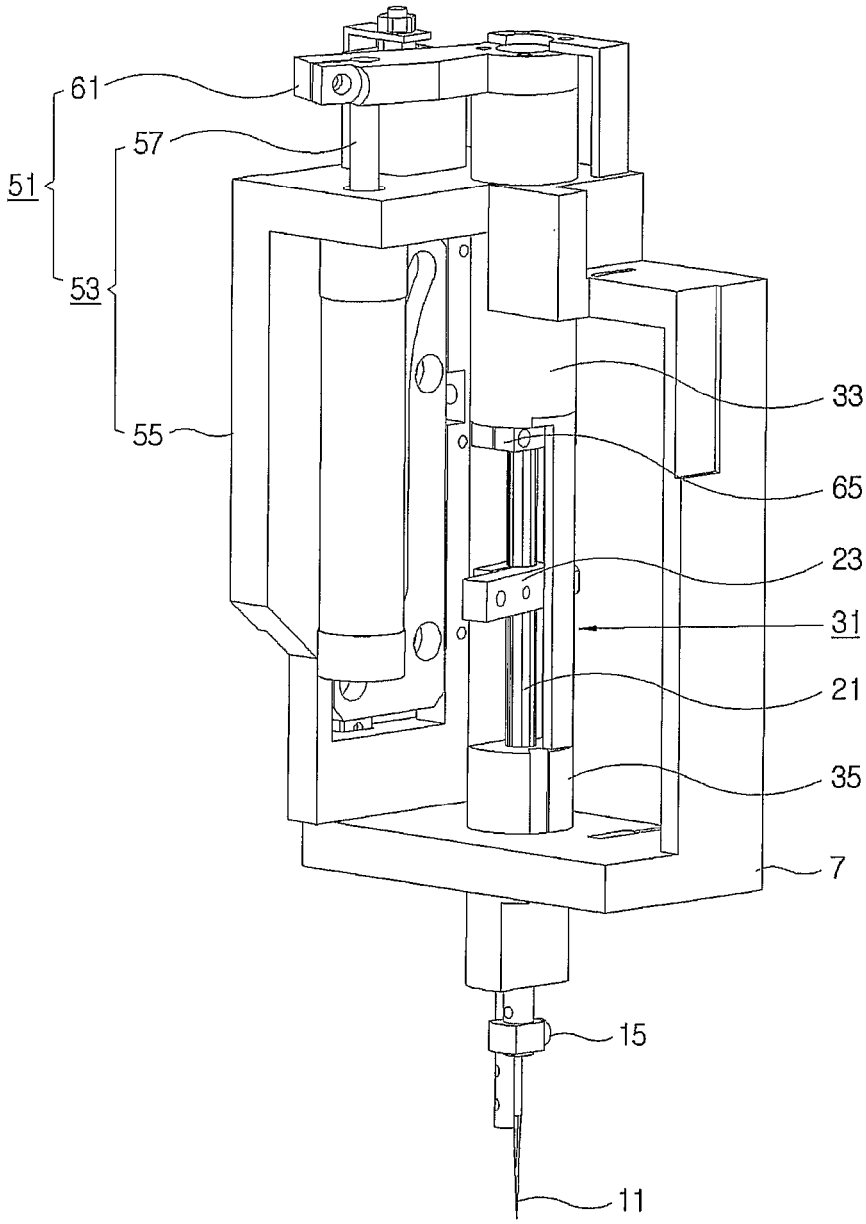
FIG. 1 is a perspective view of a sewing machine according to an embodiment of the present invention.

Hereinbelow, the present invention will be described with reference to accompanying drawings, wherein like reference numerals refer to like elements throughout, and repetitive descriptions will be avoided as necessary.

Figure 2:
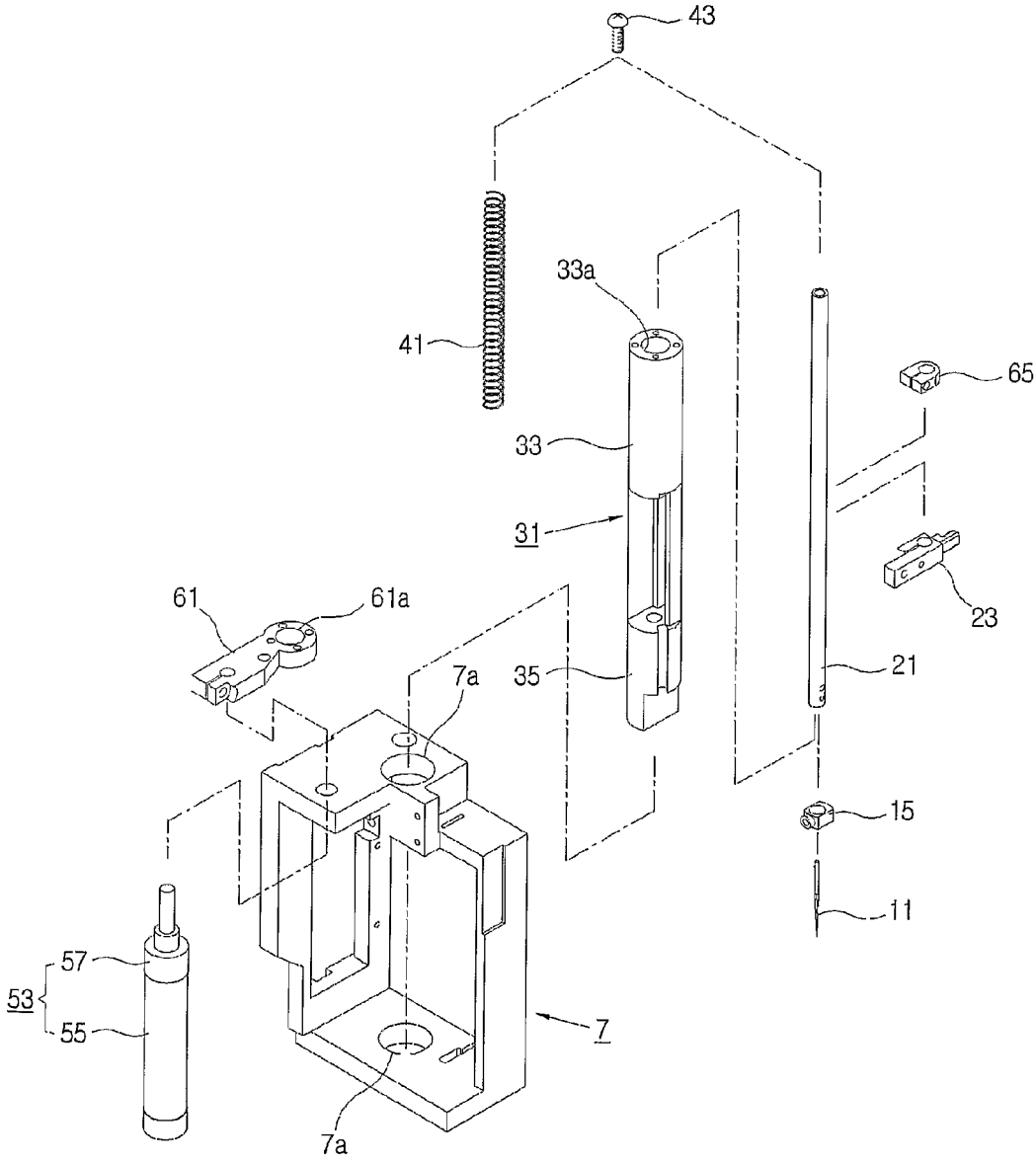
FIG. 2 is an exploded perspective view of FIG. 1.

As shown in FIGS. 1 and 2, a sewing machine 1 according to an embodiment of the present invention includes a needle 11 through which a thread supplied from a thread supplying unit (not shown) is put.

The needle 11 passes through a needle plate 5 (refer to FIG. 3), is reciprocated within a predetermined sewing work section, and is supported by a needle holder 15 at an end of a needle bar 21.

The needle bar 21 has a tube-like shape, and has one side coupled with a bracket 23. The bracket 23 is coupled to and released from a needle bar driver 25 (refer to FIG. 3) by a clutch (not shown). Here, the needle bar driver 25 drives the needle bar 21 to reciprocate. Thus, when the clutch couples the bracket 23 of the needle bar 21 with the needle bar driver 25, the reciprocation of the needle bar driver 25 is transferred to the needle bar 21 through the clutch, so that the needle 11 mounted at the end of the needle bar 21 is reciprocated within a predetermined sewing work section, thereby performing sewing work.

Here, the needle bar driver 25 may include a hydraulic cylinder, a motor, a cam device, a solenoid, or etc.

Meanwhile, the sewing machine 1 according to an embodiment of the present invention includes a lifting unit 31 to lift up and down the needle bar 21 so that the needle 11 gets out of the sewing work section and then lifts up to a predetermined auxiliary work position; an elastic unit 41 elastically connecting the lifting member 31 with the needle bar 21; and a lifting driver 51 to lift the lifting unit 31 up and down.

Here, the auxiliary work means that a user manually puts a thread through an eye of the needle 11, a threader puts a thread through the eye of the needle 11, the needle 11 is changed when the needle 11 is broken, etc.

The lifting unit 31 is connected with the needle bar 21 and allows the needle bar 21 to be lifted up and down. Further, the lifting unit 31 is installed in a through hole 7*a* of a head stem 7, and lifted up and down in the through hole 7*a*. Here, the lifting unit 31 includes a pair of guides 33 and 35 partially accommodating the needle bar 21 and guiding the needle bar 21 to be lifted up and down. Hereinafter, for the sake of convenience, the guide placed in an upper portion of the lifting unit 31 and the guide placed in a lower portion of the lifting unit 31 will be called an upper guide 33 and a lower guide 35, respectively. The upper and lower guides 33 and 35 are aligned on the same axis, and spaced apart from each other. Further, the bracket 23 of the needle bar 21 is placed between the upper and lower guides 33 and 35. In the meantime, the upper guide 33 is formed with an elastic unit accommodating groove 33*a* in which the elastic unit 41 is partially accommodated.

The elastic unit 41 is provided surrounding an outer circumference of the needle bar 21, and accommodated in the elastic unit accommodating groove 33*a* of the upper guide 33. Here, the elastic unit 41 has a first end supported on the needle bar 21 by a supporting bolt 43, and a second end supported in the elastic unit accommodating grove 33*a* of the upper guide 33, thereby elastically connecting the needle bar 21 with the lifting unit 31. Further, the elastic unit 41 is used for absorbing the shock of the needle bar 21 when the needle bar 21 is reciprocated within the sewing work section and performs the sewing work. In this embodiment, a coil spring is employed as the elastic unit 41 to elastically urge the needle bar 21 to be lifted up when the lifting unit 31 is lifted up. Alternatively, a spiral spring can be employed instead of the coil spring.

The lifting driver 51 includes a hydraulic cylinder 53 having a cylinder rod 57 to be reciprocated, and a link 61 connecting the cylinder rod 57 with the lifting unit 31.

The hydraulic cylinder 53 includes a cylinder body 55, and the cylinder rod 57 expanding and retracting to be reciprocated by the operation of the cylinder body 55. The cylinder body 55 is supported by the head stem 7. Further, the cylinder rod 57 is disposed in parallel with the needle bar 21, leaving a predetermined space from the needle bar 21.

The link 61 is connected to a free end of the cylinder rod 57 and a top surface of the upper guide 33 by a fastening means (not shown). Further, one surface of the link 61 is formed with a passing hole 61*a* that communicates with the elastic unit accommodating groove 33*a* of the upper guide 33 and passes the needle bar 21 therethrough.

Thus, when the cylinder rod 57 is reciprocated by the operation of the hydraulic cylinder 53, the reciprocation of the cylinder rod 57 is transferred to the lifting unit 31 through the link 61, so that the lifting unit 31 is reciprocated along with the cylinder rod 57, i.e., lifted up and down.

In this embodiment, the hydraulic cylinder 53 is employed for lifting up and down the lifting unit 31 by expanding and retracting operations using a hydraulic pressure, but not limited to. Alternatively, a motor, a cam device, a solenoid, etc. can be employed for lifting up and down the lifting unit 31.

In the meantime, the sewing machine 1 according to an embodiment of the present invention further includes a stopper 65 to limit the movement of the lifting unit 31 so as to place the needle 11 within the sewing work section when the lifting unit 31 is lifted down.

The stopper 65 is provided in the needle bar 21, and placed between the upper guide 33 and the bracket 23 of the needle bar 21, thereby being in contact with and apart from the bottom surface of the upper guide 33. Further, the stopper 65 is in contact with the bottom surface of the upper guide 33 at the sewing work, thereby preventing the needle 11 from getting out of the top dead point of the sewing work section. Here, the stopper 65 may be optionally provided.

With this configuration, the operations of the sewing machine 1 according to an embodiment of the present invention will be described with reference to accompanying drawings in putting the tread through the eye of the needle 11 using a threader 71.

Figure 3:
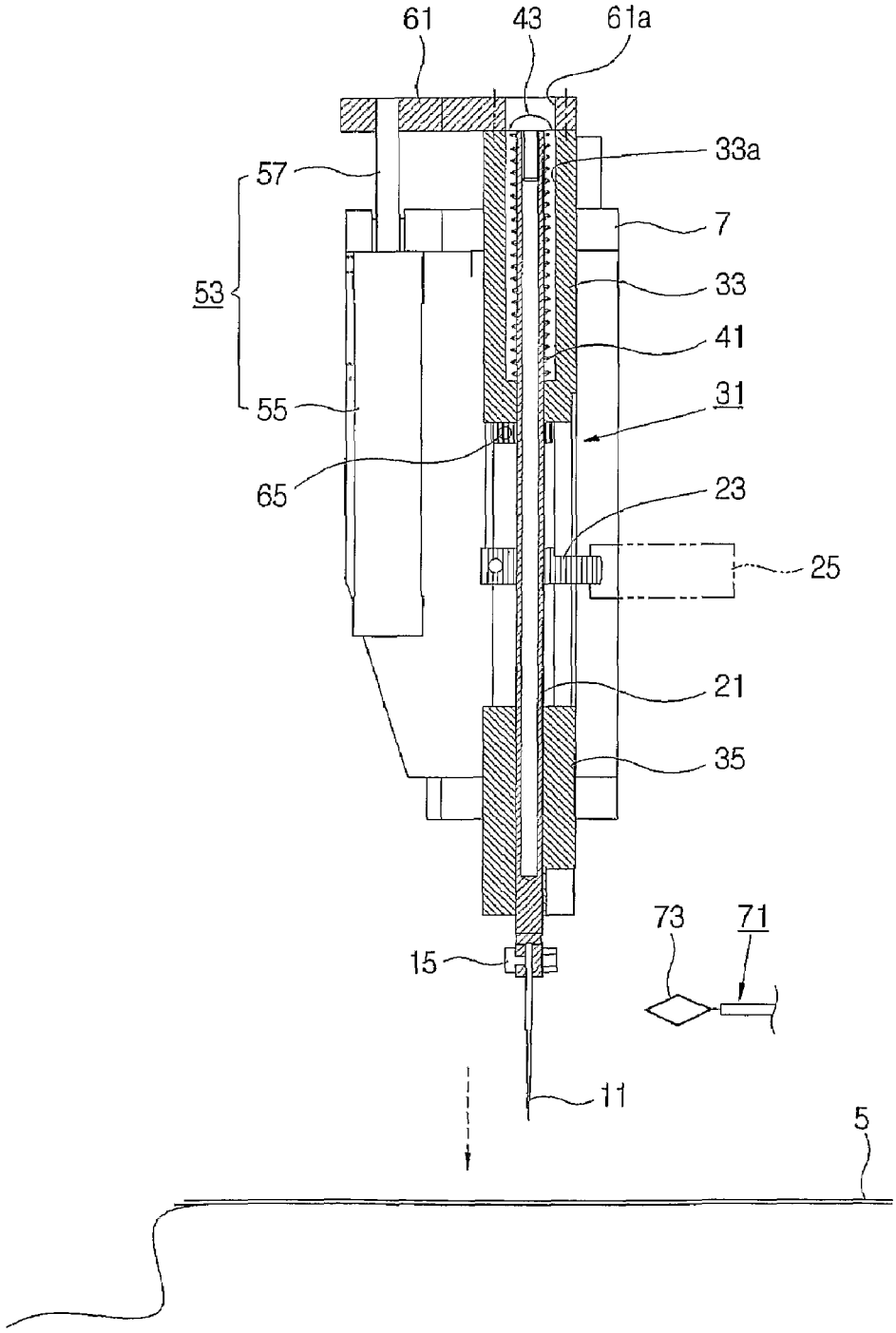
FIGS. 3 through 5 are side views illustrating operations of FIG. 1.
Figure 4:
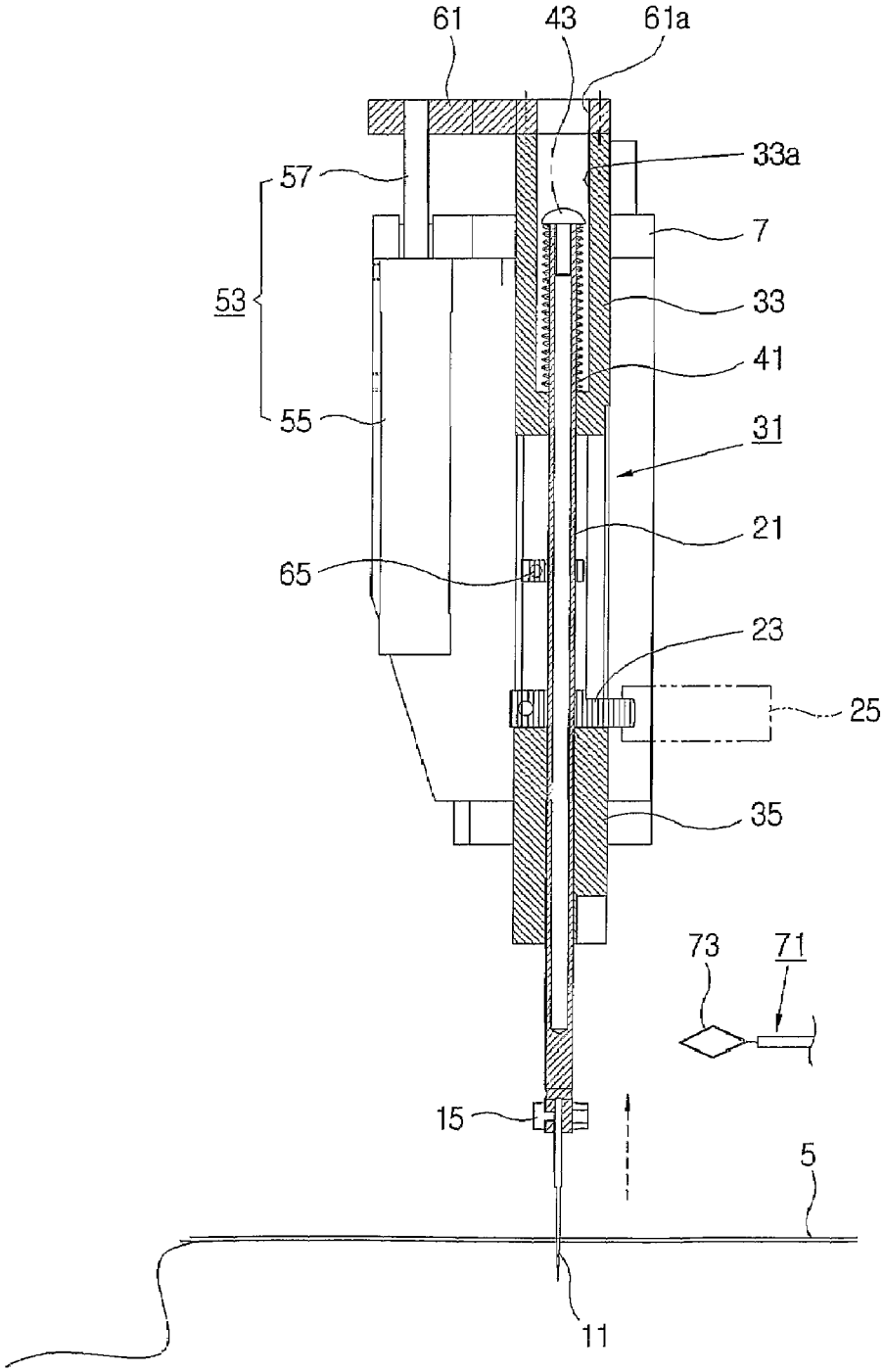

At the sewing work, as shown in FIGS. 3 and 4, the needle 11 of the sewing machine 1 passes through the needle plate 5 and is reciprocated within a predetermined sewing work section, i.e., between the top dead point and the bottom dead point.

To change the thread that is threaded in the needle 11 of the sewing machine 1, the needle 11 gets out of the top dead point of the sewing work section and then is lifted up at predetermined height.

Figure 5:
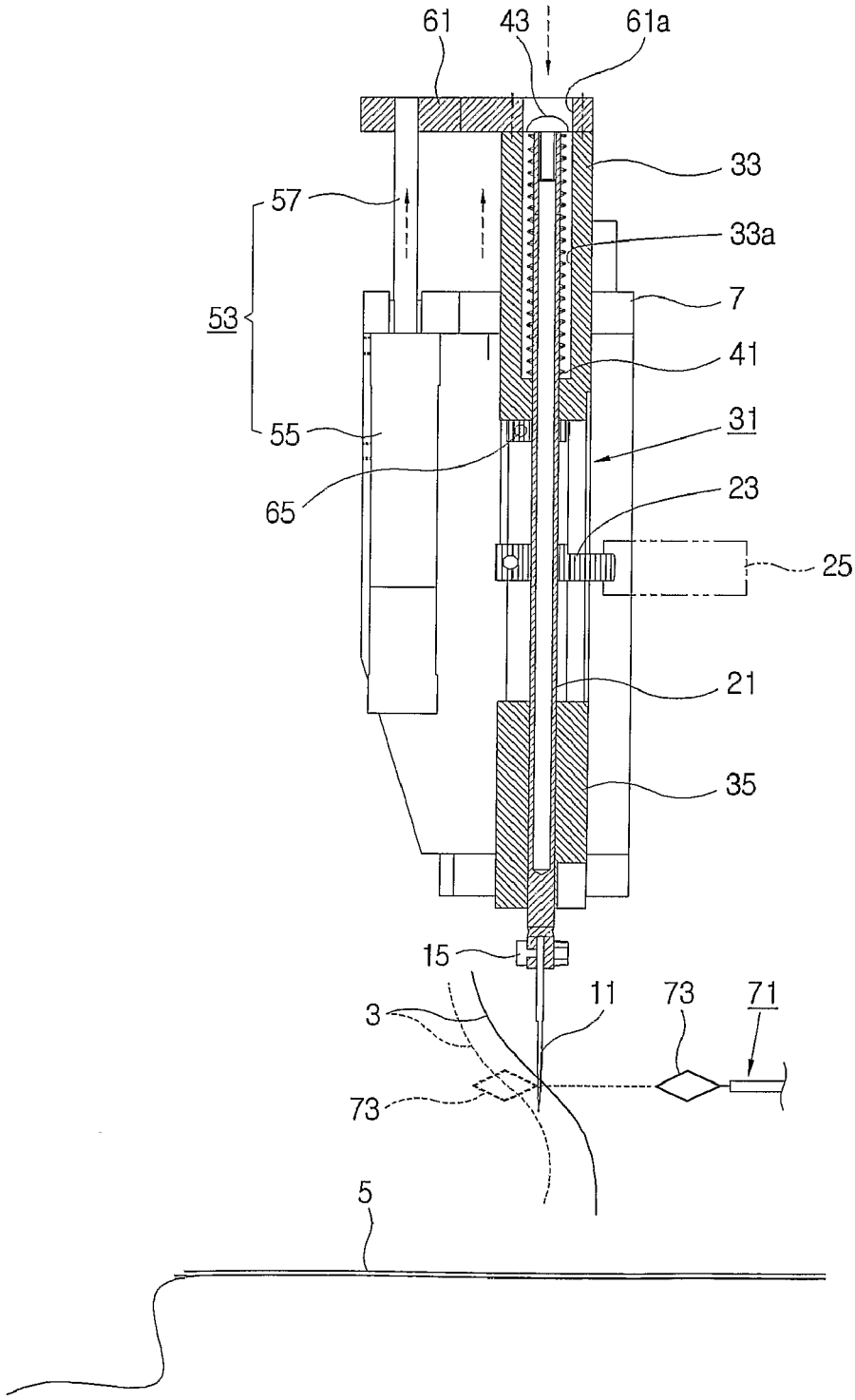

That is, in the state that the needle 11 is placed at the top dead point of the sewing work section, the hydraulic cylinder 53 of the lifting driver 51 is driven to place the eye of the needle 11 on the same plane as a loop 73 of the threader 71 as shown in FIG. 5.

Due to the operation of the hydraulic cylinder 53, the cylinder rod 57 expands to have a predetermined length, so that the link 61 is lifted up, thereby lifting up the lifting unit 31.

As the lifting unit 31 is lifted up, the needle bar 21 is also lifted up by the elasticity of the elastic unit 41. At this time, if the needle bar 21 and the needle bar driver 25 are connected with each other, a trouble arises in lifting up the needle bar 21. To prevent the trouble from arising, the needle bar 21 is disconnected from the needle bar driver 25 by the clutch.

As the needle bar 21 is lifted up, the needle 11 gets out of the top dead point of the sewing work section and is lifted up at a predetermined height, so that the eye of the needle 11 is placed on the same plane as the loop 73 of the threader 71.

Thus, the thread 3 supplied from the thread supplying unit (not shown) is threaded in the needle 11 as the loop 73 of the threader 71 operates.

After the thread is completely threaded in the needle 11, the hydraulic cylinder 53 of the lifting driver 51 is driven to retract the cylinder rod 57 to have a predetermined length, so that the link 61 is lifted down and thus the lifting unit 31 is lifted down, thereby returning the needle 11 to its original position.

As the lifting unit 31 is lifted down, the bottom surface of the upper guide 33 of the lifting unit 31 is in contact with the stopper 65, so that the lifting unit 31 is not lifted down any more, thereby returning the needle 11 to its original position, i.e., to the top dead point of the sewing work section.

Figure 6:
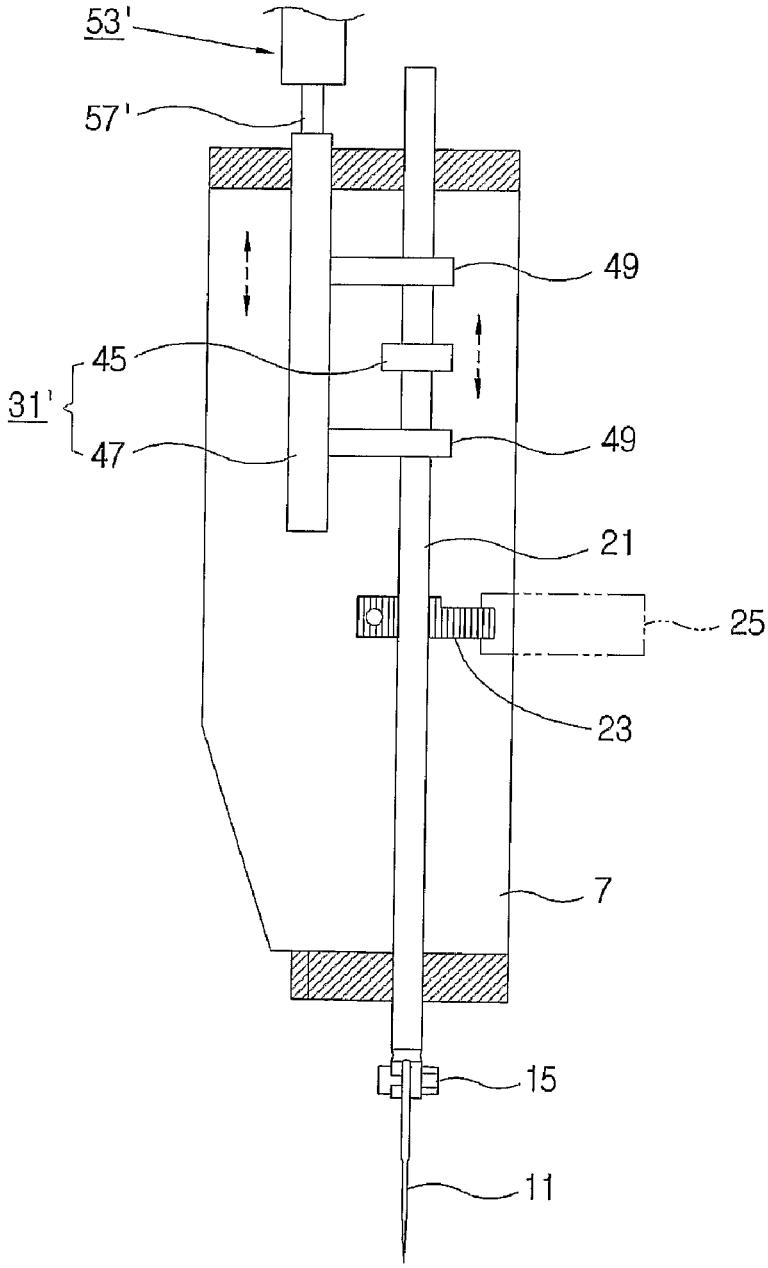
FIG. 6 is a partial side-sectional view schematically illustrating a lifting unit and a lifting driver according to another embodiment of the present invention.

In the meantime, FIG. 6 illustrates a lifting unit and a lifting driver of a sewing machine according to another embodiment of the present invention. As shown therein, a lifting unit 31' includes a projection 45 protruded from an outer circumference of the needle bar 21, and a lifting rod 47 lifted up and down being in contact with and apart from the projection 45.

The lifting rod 47 is disposed in parallel with an axis line of the needle bar 21, leaving a predetermined space from the axis line of the needle bar 21. The outer circumference of the lifting rod 47 is provided with a pair of guide rings 49 to partially accommodate the needle bar 21 and guide the movement of the needle bar 21. Here, the projection 45 provided in the needle bar 21 is disposed between the pair of guide rings 49. Preferably, the distance between the guide rings 49 is larger than the interval of the sewing work section of the needle 11, so that the projection 45 reciprocated along with the needle bar 21 does not interfere with the guide ring 49 when the needle 11 performs the sewing work.

In this embodiment, the lifting rod 47 is directly connected to a hydraulic cylinder 53' having a cylinder rod 57' reciprocated as the lifting driver.

With this configuration, as the lifting rod 47 is lifted up and down by the reciprocation of the cylinder rod 57' of the hydraulic cylinder 53', the pair of guide rings 49 of the lifting rod 47 alternately contacts the projection 45, thereby lifting up and down the needle bar 21. For example, when the cylinder rod 57' expands, the guide ring 49 placed in an upper portion of the lifting rod 47 is in closely contact with the top surface of the projection 45, thereby lifting the needle bar 21 down. On the other hand, when the cylinder rod 57' retracts, the guide ring 49 placed in a lower portion of the lifting rod 47 is in closely contact with the bottom surface of the projection 45, thereby lifting the needle bar 21 up.

As the lifting driver operates, the guide ring 49 of the lifting rod 47 is interlocked with the projection 45 of the needle bar 21, so that the needle 11 gets out of the sewing work section and is lifted up to a predetermined auxiliary work position.

Thus, not only the objects of the present invention are achieved but also the lifting structure of the needle bar is more simplified.

Here, the hydraulic cylinder 53' is used as the lifting driver, but not limited to. Alternatively, a motor or the like as well as the hydraulic cylinder 53' can be used for lifting the lifting rod 47 up and down.

Thus, the needle bar is lifted up and down in order to get the needle out of the sewing work section and lift the needle up to a predetermined auxiliary work position, so that it is easy to put the thread through the eye of the needle using the threader or manually, change the needle, etc.

In particular, the thread is threaded in the needle by lifting up and down the needle bar, and thus the threader gets out of the sewing work section, so that the workspace between a sewing object and the threader is increased, thereby reducing interference between the brim of the hat and the threader when the sewing object such as a hat or the like is sewn.

Meanwhile, it will be appreciated by those skilled in the art that the spirits of the present invention can be applied to various sewing machines such as a single needle automatic embroidering machine, a multi needle automatic embroidering machine, etc.

As described above, the present invention provides a sewing machine capable of decreasing work inconvenience and enhancing work efficiency.

What is claimed is:

1. A sewing machine comprising a needle bar mounted with a needle reciprocating within a predetermined sewing work section, and a needle bar driver to drive the needle bar to reciprocate, the sewing machine further comprising:

a lifting unit to lift up and down the needle bar to make the needle get out of the sewing work section and reach a predetermined auxiliary work position;

a lifting driver driving the lifting unit to be lifted up and down;

an elastic unit elastically connecting the lifting unit with the needle bar, and urging the needle bar to be lifted up by predetermined elasticity when the lifting unit is lifted up; and a stopper provided in the needle bar and limiting movement of the lifting unit to place the needle within the sewing work section when the lifting unit is lifted down.

2. The sewing machine according to claim 1, wherein the lifting driver comprises: a hydraulic cylinder comprising a cylinder rod to reciprocate; and a link connecting the cylinder rod and the lifting unit, and transferring the reciprocation of the cylinder rod to the lifting unit.

3. The sewing machine according to claim 1, wherein the lifting unit comprises:

a projection protruded from an outer circumference of the needle bar; and a lifting rod lifted up and down being in contact with and apart from the projection.

* * * * *